US006468468B1

(12) United States Patent
Neubing et al.

(10) Patent No.: US 6,468,468 B1
(45) Date of Patent: Oct. 22, 2002

(54) METHOD FOR PREPARATION OF SINTERED PARTS FROM AN ALUMINUM SINTER MIXTURE

(75) Inventors: Hans-Claus Neubing, Velden (DE); Johann Gradl, Neuhaus (DE); Armin Müller, Schlammersdorf (DE)

(73) Assignee: Ecka Granulate GmbH & Co. KG, Furth (DE)

( * ) Notice: Subject to any disclaimer, the term of this patent is extended or adjusted under 35 U.S.C. 154(b) by 0 days.

(21) Appl. No.: 09/692,314

(22) Filed: Oct. 20, 2000

(30) Foreign Application Priority Data

Oct. 21, 1999 (DE) ..... 199 50 595

(51) Int. Cl.[7] ..... B22F 3/12
(52) U.S. Cl. ..... 419/38; 419/57
(58) Field of Search ..... 419/38, 57; 75/249

(56) References Cited

U.S. PATENT DOCUMENTS

| | | | | |
|---|---|---|---|---|
| 4,177,069 A | * | 12/1979 | Kobayashi et al. | |
| 4,283,465 A | * | 8/1981 | Morimoto et al. | 428/566 |
| 5,328,501 A | | 7/1994 | McCormick et al. | |
| 5,466,277 A | * | 11/1995 | Miura et al. | 75/255 |
| 5,613,184 A | * | 3/1997 | Purnell et al. | 419/38 |
| 5,902,943 A | | 5/1999 | Schaffer et al. | |

FOREIGN PATENT DOCUMENTS

| | | |
|---|---|---|
| DE | 693 07 848 | 8/1997 |
| DE | 69221 690 | 4/1998 |
| EP | 0 436 952 | 7/1991 |
| EP | 0 588 439 | 3/1994 |
| EP | 0 669 404 | 8/1995 |

* cited by examiner

*Primary Examiner*—Ngoclan Mai
(74) *Attorney, Agent, or Firm*—Smith, Gambrell & Russell, LLP

(57) ABSTRACT

Described is a process for producing sintered parts from an aluminum sintering mixture, wherein between 10 and 70% by weight of pure aluminum powder and between 30 and 90% by weight of an aluminum alloy powder are mixed to form an aluminum sintering mixture. The aluminum alloy powder is of the following composition:

between 14 and 35% by weight of Si;

between 1 and 7% by weight of Cu;

between 0.3 and 2.5% by weight of Mg;

between 0.3 and 6% by weight of a transition metal, the balance aluminum.

The pure alloy powder and the aluminum alloy powder are each of a grain size of a maximum of 315 $\mu$m. The aluminum sintering mixture is mixed with between 0.5 and 2% by weight of compacting additive. The mix of alloy sintering mixture and compacting additive is compacted to form a green compact. The green compact is then sintered. As no low-melting phases occur in the invention, sintered bodies which are stable in respect of shape are reproducibly obtained in the sintering operation.

9 Claims, No Drawings

METHOD FOR PREPARATION OF SINTERED PARTS FROM AN ALUMINUM SINTER MIXTURE

The invention concerns a process for producing sintered parts from an aluminum sintering mixture.

A wear-resistant sintered aluminum alloy which comprises in parts by weight between 2.4 and 23.5% of Si, between 2 and 5% of Cu, between 0.2 and 1.5% of Mg, between 0.01 and 1% of one or more elements from the group consisting of the transition metals Ti, V, Zr, Mn, Fe, Co, Ni and Nb, and the balance aluminum, with inevitable impurities, is known from EP 0 669 404 B1. The alloy has a fleck-like grain structure comprising an Al-mixed crystal phase and an Al-Si-alloy phase, wherein the latter has dispersed hypereutectic Si-crystallites with a maximum diameter of between 5 and 60 $\mu$m and the region of the Al-mixed crystal phase is between 20 and 80% of the cross-section of the fleck grain structure. In addition, a process for producing a wear-resistant sintered aluminum alloy is known from the above-indicated document, comprising the process steps:

producing a mixture of between 20 and 80% by weight of Al-Si-alloy powder with between 13 and 30% by weight of Si and between 80 and 20% by weight of Al-powder, adding a Cu-transition metal alloy powder with between 0.2 and 30% by weight of one or more of the transition metals Ti, V, Cr, Mn, Fe, Co, Ni, Zr and Nb, and an Mg-powder or an Al—Mg-alloy powder with 35% by weight or more of Mg to form the mixture of Al-powder and Al—Si-alloy powder, thereby affording a powder mixture of a composition comprising between 2.4 and 23.5% by weight of Si, between 2 and 5% by weight of Cu, between 0.2 and 1.5% by weight of Mg and between 0.01 and 1% by weight of the transition metal, with the balance being aluminum and with inevitable impurities, compacting of the powder mix obtained in that way to form a green sintered preform, and terminating with sintering of the green sintered preform to afford the sintered part.

In that case, the hypereutectic Si-crystallites which are contained in the Al—Si-alloy phase in the. sintered aluminum alloy grow to a size of between 5 and 60 $\mu$m. In that procedure, heating of the entire body or only the outside surface of the sintered aluminum alloy is effected. The heating procedure is followed by cooling. That known process for producing a wear-resistant sintered aluminum alloy is based on taking a binary Al-Si-alloy powder as the starting material, to which are added Al-powder and the alloying powder in the form of Mg-powder or Al-Mg-powder and Cu-powder or Cu-alloy powder. Due to those added alloy powders, low-melting phases are formed, by which liquid phase sintering is possible.

EP 0 436 952 B1 discloses a mixed aluminum alloy powder for the production of a compacted and sintered aluminum alloy, comprising a mixture of the following components:

an aluminum alloy primary initial powder (A) which (in terms of weight) comprises the following constituents:

between 0.1 and 3.0% of Cu and optionally between 0.1 and 2.0% of at least one element selected from Mn, Ni, Fe, Cr, Zr, Ti, V, Pb, Bi and Sn, wherein the balance is Al and inevitable impurities, and a master alloy initial powder (B) comprising the following constituents (in percent by weight):

between 4 and 20% of Mg, between 12 and 30% of Si and optionally between 0.1 and 8% of at least one of the elements Mn, Ni, Fe, Cr, Zr, Ti, V, Pb, Bi and Sn, with the balance being Al and random impurities. The master alloy powder (B) can also comprise the following constituents (in percent by weight):

between 4 and 20% of Mg, between 12 and 30% of Si, between 1 and 30% of Cu, and optionally between 0.1 and 8% of at least one of the elements Mn, Ni, Fe, Cr, Zr, Ti, V, Pb, Bi and Sn, with the balance being Al and random impurities, wherein the master alloy (B) is present in a range of between 2 and 15% in order to obtain the following composition in the mixed powder (in percent by weight):

between 0.1 and 2.0% of Mg, between 0.1 and 2.0% of Si, between 0.2 and 6% of Cu and optionally 4.0% or less overall of Mn, Ni, Fe, Cr, Zr, Ti, V, Pb, Bi and/or Sn.

This involves an aluminum alloy powder for the production of aluminum sintered parts, wherein two aluminum alloy powders are mixed together. After that mixing operation the composition is as follows:

between 0.1 and 2% by weight of Si, between 0.2 and 6.0% by weight of Cu, between 0.1 and 2% by weight of Mg, and optionally 4% by weight or less of Mn and/or Ni and/or Fe and/or Cr and/or Zr and/or Ti and/or V and/or Pb and/or Zr and/or Sn.

The composition of the alloy powders used in this case also makes it possible to form low-melting phases and thus liquid phase sintering.

The low-melting phases which occur in liquid phase sintering mean that, during the heating operation, growth and/or shrinkage phenomena occur and therefore the sintering process can only be controlled with difficulty. The liquid phase component during the sintering operation means that it is often not possible to prevent distortion of the sintered parts produced, thus resulting in unwanted dimensional variations. The mechanical properties of the sintered parts produced may fluctuate within a relatively wide range of values.

The object of the present invention is to provide a process of the kind set forth in the opening part of this specification with which it is possible to produce sintered parts with excellent resistance to wear and a high level of mechanical strength, while the sintering procedure can be implemented in a relatively easily controlled fashion and distortion of the sintered parts produced can be avoided.

In accordance with the present invention that object is attained by the features of claim 1, in that between 10 and 70% by weight of pure aluminum powder and between 30 and 90% by weight of an aluminum alloy powder are mixed to form an aluminum sintering mixture, the aluminum powder alloy powder being of the following composition:

between 14 and 35% by weight of Si, between 1.0 and 7% by weight of Cu, between 0.3 and 2.5% by weight of Mg, between 0.03 and 6% by weight of at least one of the group consisting of Ti, Fe, V, Zr, Ni, and Cr, and the balance aluminum, the pure aluminum powder and the aluminum alloy powder respectively being of a maximum grain size of 350 $\mu$m, preferably a maximum of 200 $\mu$m, the aluminum sintering mixture is mixed with between 0.5 and 2% by weight of compacting additive, and the mix of aluminum sintering mixture and compacting additive is compacted to form a green preform and the green preform is then sintered.

The nominal composition of the aluminum sintered parts is as follows:

Si between 4.5 and 31.0%

Cu between 0.3 and 6.0%

Mg between 0.1 and 1.2%, and one or more elements from the group consisting of Ti, Fe, V, Zr, Ni, Cr in a total of between 0.01 and 5.0%.

The Al-alloy powder and the pure Al-powder are preferably used in the same grain size. The compacting additive may involve a wax in fine powder form, preferably an amide wax, as may be conventionally employed in powder metallurgy.

The aluminum alloy powder and the pure aluminum powder may each be produced by atomisation of the corresponding melt in a protective gas atmosphere or in air. In that respect, the aluminum alloy powder is desirably produced by atomisation of the corresponding melt, the atomisation medium for atomisation of the melt preferably being a protective gas such as for example nitrogen or argon. The atomisation procedure can be executed in known installations. The pure aluminum powder is also produced by atomisation of the melt. This can also be effected in known manner in a protective gas or air atmosphere. Preferably the pure aluminum powder is atomised in air because that results in an irregular grain shape. The irregular grain shape affords the advantage that, upon compacting of the aluminum sintering mixture, the green preforms enjoy a comparatively high level of green strength.

It has proven to be advantageous with the process according to the invention if the melt comprising the aluminum alloy powder is rapidly quenched in such a way that eutectic hardening is substantially suppressed and the hypereutectic Si-content is precipitated in the form of Si-primary crystallites present in a fine homogeneous distribution with a crystallite size of a maximum of 25 $\mu$m, with the entire Si-content being above the eutectic composition.

The mix of aluminum sintering mixture and compacting additive is compacted to a value of the order of magnitude of 95% of the theoretical density. As in accordance with the invention no intermediary low-melting phases occur up to the sintering temperature of between 530 and 565° C., preferably between 540 and 560° C., no liquid phase sintering occurs. In contrast to the known processes in which intermediary low-melting phases (liquid phase sintering) occur, the solid-phase sintering procedure according to the invention provides that, by virtue of the composition of the sintering mixture according to the invention without an intermediary liquid phase, a sintered body which is stable in respect of shape is obtained. During the heating operation up to the solid-phase sintering temperature, no uncontrolled growth/shrinkage phenomena occur, as have been referred to hereinbefore in connection with liquid phase sintering, and the invention advantageously does not involve any distortion of the sintered parts.

During the sintering operation, the alloy elements partially diffuse from the aluminum alloy powder into the pure aluminum. Diffusion phenomena result in an equalisation of concentration in respect of the alloy elements, while the procedure also involves partial re-distribution of the Si-primary crystallites from the aluminum alloy powder into the pure aluminum powder. The pores are rounded off during the sintering procedure, thus resulting in a reduction in the pore volume. That reduction in pore volume causes shrinkage of the green compacts of the sintered parts. The degree of shrinkage can advantageously be controlledly reproduced when the sintering conditions are observed.

Sintering of the green compact for the sintered part is preferably effected in a protective gas atmosphere. This may be a pure nitrogen atmosphere with a low dew point.

A step for dewaxing of the green compact can be effected prior to the sintering operation. The dewaxing operation can be effected for example at a temperature of the order of magnitude of 400° C. There is no need for the temperature to be precisely controlled in the dewaxing operation, as is absolutely necessary in conventional liquid phase sintering.

If necessary, a heat treatment and/or a calibration operation can be implemented after the sintering operation for the purposes of increasing strength. That increase in strength for the sintered products can be achieved in particular by the following procedures:

a) cold forming, b) heat treatment corresponding to the $T_4$- and $T_6$-state, and c) sinter forging.

The process according to the present invention will be set forth in greater detail below.

50% by weight of aluminum alloy powder atomised under a protective gas atmosphere, 50% by weight of pure aluminum powder and in addition 1% by weight of amide wax are compacted under a compacting pressure of 62 kN/cm$^3$ . The compacting density after that operation is 2.5 g/cm$^3$. The green strength of the green preform produced thereby is 13.5 MPa. Before the sintering temperature is reached the preform is dewaxed at a temperature of 400° C. Sintering of the green preform is effected in a dry nitrogen atmosphere. The sintering temperature is 550° C. and the sintering time is 60 minutes. In the case of an elongate sintered part measuring 90 mm in length, the linear sintering shrinkage is 3% relative. The tensile strength of the sintered parts is 230 Mpa directly after the sintering operation ($T_1$-state). If then a precipitation hardening operation, that is to say solution heat treatment at a temperature of 510° C., rapid quenching and hot ageing at a temperature of 170° C. is effected ($T_6$ -state), that results in a tensile strength of 300 MPa. A high level of resistance to wear of the sintered parts produced in that way is ensured by the high proportion of hard, finely distributed Si-crystallites.

If in comparison therewith only a known binary Al-Si-prealloy, for example an AlSi-22-alloy powder, and a pure aluminum powder and a compacting aid is used, it is only possible to produce therefrom sintered parts which involve low or inadequate strength properties. Thus the tensile strength of a sintered part of the last-mentioned composition, of a density of 2.5 g/cm$^3$, at a sintering temperature of 560° C. and a sintering time of 60 minutes, is only 90 MPa, which means that the corresponding sintered part produced by the process according to the invention enjoys a tensile strength which is many times greater.

In the case of a mixture comprising 75% of AlSi-22-alloy powder, 20% of pure aluminum powder and 2% of aluminum-magnesium alloy powder of a composition of 50% of Mg and 50% of Al, 3% of copper powder and compacting additive, low-melting phases are obtained upon sintering. When that mixture is sintered at 550° C. and for 60 minutes, sinter strengths in the $T_1$-state of only 110 MPa are attained. By virtue of the low-melting phases, the dimensional accuracy of the sintered parts produced in that case are worse than in the case of sintered parts produced by the process in accordance with the invention.

What is claimed is:

1. A process for producing sintered parts from an aluminum sintering mixture comprising the following steps:

mixing between 10 and 70% by weight of a pure aluminum power and between 30 and 90% by weight of an aluminum alloy powder to form an aluminum sintering mixture;

mixing the aluminum sintering mixture with between 0.5% and 2% by weight of a compacting additive to form a mix;

compacting the mix to form a green preform; and sintering the green preform;

wherein the aluminum alloy powder comprises:

aluminum, between 14 and 35% by weight of Si, between 1.0 and 7% by weight of Cu, between 0.3 and 2.5% by weight of Mg, between 0.03 and 6% by weight of one or more elements selected from the group consisting of Ti, Fe, V, Zr, Ni, and Cr; and wherein the pure aluminum powder and the aluminum alloy powder have a maximum grain size of 350 $\mu$m.

2. A process as set forth in claim 1, further comprising the step of:

atomizing an aluminum alloy powder melt and a pure aluminum powder melt in a protective gas environment or in air to respectively produce the aluminum alloy powder and the pure aluminum powder.

3. A process as set forth in claim 1, further comprising the step of:

atomizing a pure aluminum powder melt in air to produce the pure aluminum powder.

4. A process as set forth in claim 2, further comprising the step of:

quenching the aluminum alloy powder melt such that Si-primary crystallites are present in a fine distribution of a maximum of 25 $\mu$m, with the Si-content being above the eutectic composition.

5. A process as set forth in claim 1, wherein the mix is compacted to 95% of a theoretical density for the green preform.

6. A process as set forth in claim 1, wherein the sintering of the green preform is effected in a protective gas atmosphere.

7. A process as set forth in claim 6, wherein the sintering of the green preform is effected in a pure nitrogen atmosphere with a low dew point.

8. A process as set forth in one of the preceding claims, further comprising the step of:

dewaxing the green preform prior to the sintering.

9. The process according to claim 1, wherein the pure aluminum powder and the aluminum alloy powder have a maximum grain size of 200 $\mu$m.

* * * * *